US006913180B2

(12) United States Patent
Schuster

(10) Patent No.: US 6,913,180 B2
(45) Date of Patent: Jul. 5, 2005

(54) NAIL GUN

(75) Inventor: Michael G. Schuster, Joliet, IL (US)

(73) Assignee: George A. Schuster, Joliet, IL (US)

( * ) Notice: Subject to any disclaimer, the term of this patent is extended or adjusted under 35 U.S.C. 154(b) by 2 days.

(21) Appl. No.: 10/170,263

(22) Filed: Jun. 12, 2002

(65) Prior Publication Data

US 2003/0010803 A1 Jan. 16, 2003

Related U.S. Application Data

(63) Continuation-in-part of application No. 09/905,365, filed on Jul. 16, 2001, now Pat. No. 6,557,743.

(51) Int. Cl.[7] ..... B25C 3/00
(52) U.S. Cl. ..... 227/109; 227/120
(58) Field of Search ..... 227/107, 109, 227/120, 135, 136, 137, 140

(56) References Cited

U.S. PATENT DOCUMENTS

| | | | | |
|---|---|---|---|---|
| 1,709,399 A | | 4/1929 | Herlach | |
| 2,147,208 A | * | 2/1939 | Nolan | 42/49.01 |
| 3,007,171 A | | 11/1961 | Critchley | |
| 3,266,697 A | | 8/1966 | Fielder | |
| 3,504,840 A | | 4/1970 | Wandel | |
| 4,139,136 A | | 2/1979 | Catalano | |
| 5,096,109 A | | 3/1992 | Chen | |
| 5,368,213 A | * | 11/1994 | Massari, Jr. | 227/123 |
| 5,497,631 A | * | 3/1996 | Lorentzen et al. | 62/115 |
| 5,556,020 A | | 9/1996 | Hou | |
| 5,575,415 A | | 11/1996 | Sucher | |
| 5,632,431 A | * | 5/1997 | Lin | 227/109 |
| 5,695,108 A | * | 12/1997 | Lee | 227/109 |
| 5,794,832 A | * | 8/1998 | Chen | 227/109 |
| 5,803,338 A | * | 9/1998 | Singer et al. | 227/8 |
| 6,092,711 A | * | 7/2000 | Tinarelli | 227/109 |
| 6,161,746 A | | 12/2000 | Wey | |
| 6,173,877 B1 | | 1/2001 | Wingert | |
| 6,299,046 B1 | | 10/2001 | Chen | |
| 6,641,019 B2 | * | 11/2003 | Hadfield | 227/109 |

FOREIGN PATENT DOCUMENTS

| | | | | |
|---|---|---|---|---|
| JP | 2-180568 | * | 7/1990 | 227/109 |

OTHER PUBLICATIONS 2 pages of a sell sheet and parts list, NV50AP2 Plasti–Tacker Plus, Hitachi Koki U.S.A., Ltd., of Norcross, Georgia, aware of before Jun. 12, 2002.

* cited by examiner

*Primary Examiner*—Louis K. Huynh
*Assistant Examiner*—Nathaniel Chukwurah
(74) *Attorney, Agent, or Firm*—Leydig, Voit & Mayer, Ltd.

(57) ABSTRACT

A nail gun for conveniently nailing fasteners of different sizes and/or types is disclosed. The nail gun includes a body and a nail storage mechanism. The body includes a selectively operable drive mechanism. The nail storage mechanism includes first and second supply magazines movably mounted to the body whereby each supply magazine is selectively moved into position for use. Each supply magazine is loaded with nails of different sizes and/or types. Each supply magazine is selectively moved relative to the drive mechanism to a drive position wherein the supply magazine is operably arranged with the drive mechanism to selectively discharge a nail in a firing position from the supply magazine. A mounting mechanism is provided to pivotally mount the supply magazines to the body. The body includes a supply magazine support mechanism, which is selectively cooperate with the supply magazine in the drive position to support that supply magazine.

45 Claims, 10 Drawing Sheets

NAIL GUN

CROSS-REFERENCE TO RELATED PATENT APPLICATIONS

This patent application is a continuation-in-part of U.S. patent application Ser. No. 09/905,365 filed Jul. 16, 2001, now U.S. Pat. No. 6,557,743 and entitled "Multi-Chamber Nail Gun," which is incorporated in its entirety herein by this reference.

FIELD OF THE INVENTION

This invention pertains to powered nail guns, and more particularly to a nail gun for nailing fasteners of different sizes and types.

BACKGROUND OF THE INVENTION

Nail guns have become increasingly popular in recent years. More and more frequently professional carpenters have turned to power nail guns to facilitate framing and trim installations. A nail gun can be driven by pneumatic or electric means or can be powder-actuated, for example. Such a nail gun can speed nailing and requires less skill to operate than a hammer.

However, a nail gun has certain drawbacks. For example, the cost of a nail gun can be many times more than the cost of a standard hammer. In the case of a pneumatic nail gun, a compressor is required, which also increases cost.

In a typical application, such as detailing a door frame with trim, the carpenter may desire to use nails of different lengths. In such a situation, when the carpenter is using a nail gun, the carpenter has been forced to either have two nail guns or change the nails housed in the supply magazine whenever he wished to change his nail size. Such an arrangement can increase costs and be cumbersome, however, particularly so when the carpenter is on a ladder.

BRIEF SUMMARY OF THE INVENTION

The invention provides a nail gun for conveniently nailing fasteners of different sizes and types. It provides a powered nail gun having a body and a nail storage mechanism. The body can include a selectively operable drive mechanism and a gripping portion. The nail storage mechanism can include a plurality of supply magazines movably mounted to the body whereby each supply magazine can be selectively moved into position for use. Each supply magazine can be loaded with nails of different sizes and/or types.

Each supply magazine can include a discharge end. One of the nails received within the respective supply magazine can be disposed in a firing position adjacent the discharge end. Each supply magazine can be configured to be selectively moved relative to the drive mechanism to a drive position wherein the supply magazine is operably arranged with the drive mechanism for selectively discharging the nail in the firing position from the supply magazine.

The drive mechanism can be pneumatically powered. The drive mechanism can include a trigger for trigger-actuated selective operation. To decrease the likelihood that the nail gun will unintentionally fire, the drive mechanism can include a safety mechanism, which can be engaged to prevent the drive mechanism from operating and disengaged to allow the drive mechanism to operate.

A mounting mechanism can be provided to pivotally mount the supply magazines to the body. The mounting mechanism can include a body-mounting member having a bearing, a pivot member having a longitudinal axis, and a magazine-mounting member. The mounting mechanism can support the supply magazines, which can rotate about the longitudinal axis of the pivot member. The mounting mechanism can be configured to move selectively the supply magazines relative to the body such that each one of the supply magazines can be moved into registration with the drive mechanism to allow the drive mechanism to fire a nail in the firing position of the respective one of the supply magazines which is in the drive position.

To provide support for the nail storage mechanism, the body can include a supply magazine support mechanism having a shoulder and a laterally extending groove, which can selectively cooperate with a stabilizing rib on each of the supply magazines. The supply magazine support mechanism can be configured such that the stabilizing rib of the supply magazine disposed in the drive position extends through the groove and is supported by the shoulder. To selectively retain the respective supply magazines in the drive position, a retaining mechanism can be provided. The retaining mechanism can include a recess disposed in the body and a plurality of catches corresponding to the plurality of supply magazines.

These and other features of the present invention will become apparent to one of ordinary skill in the art upon reading the detailed description, in conjunction with the accompanying drawings, provided herein.

DETAILED DESCRIPTION OF EMBODIMENTS OF THE INVENTION

Figure 1:
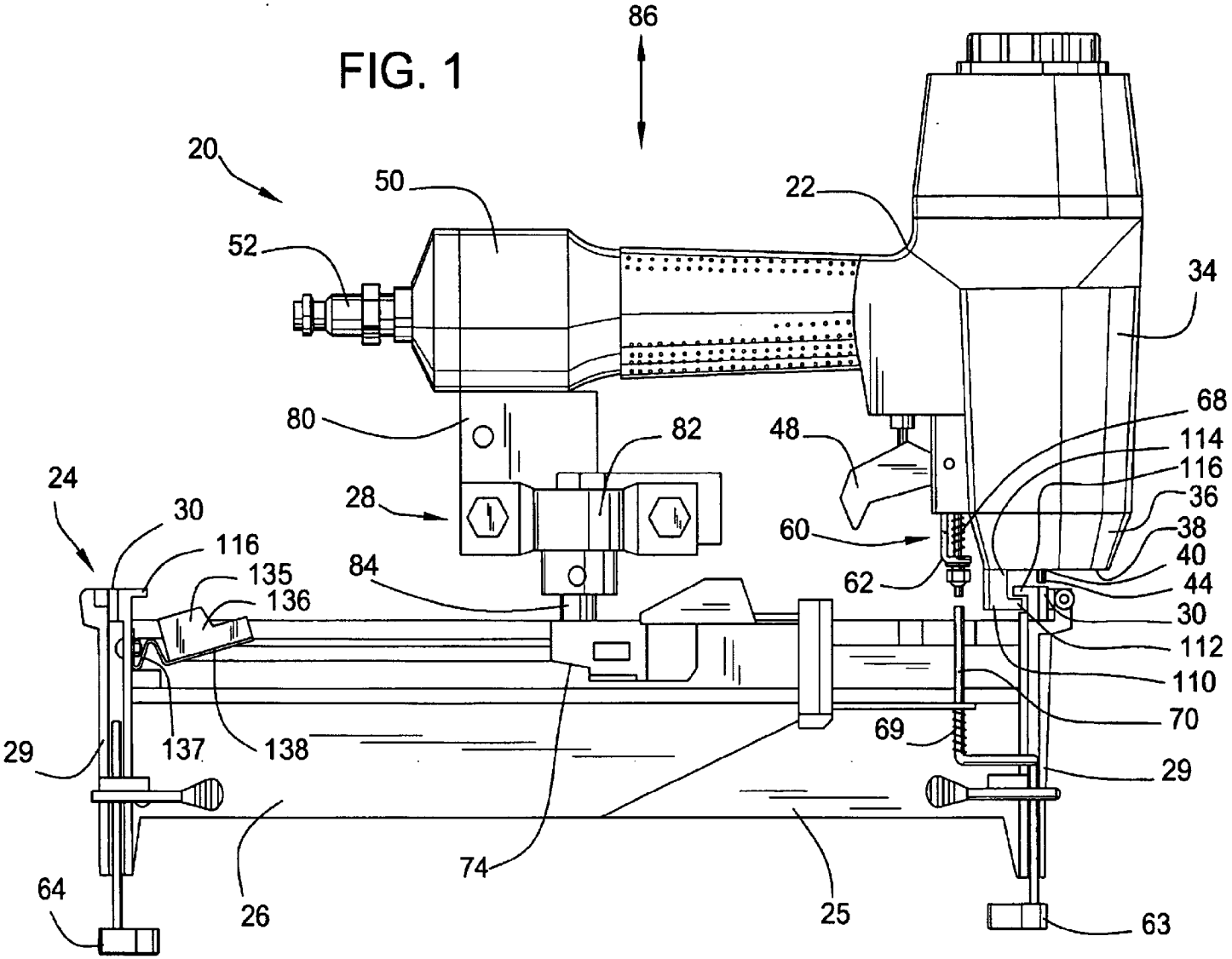
FIG. 1 is a first side elevational view of a nail gun in accordance with the present invention having two supply magazines movably mounted thereto.
Figure 6:
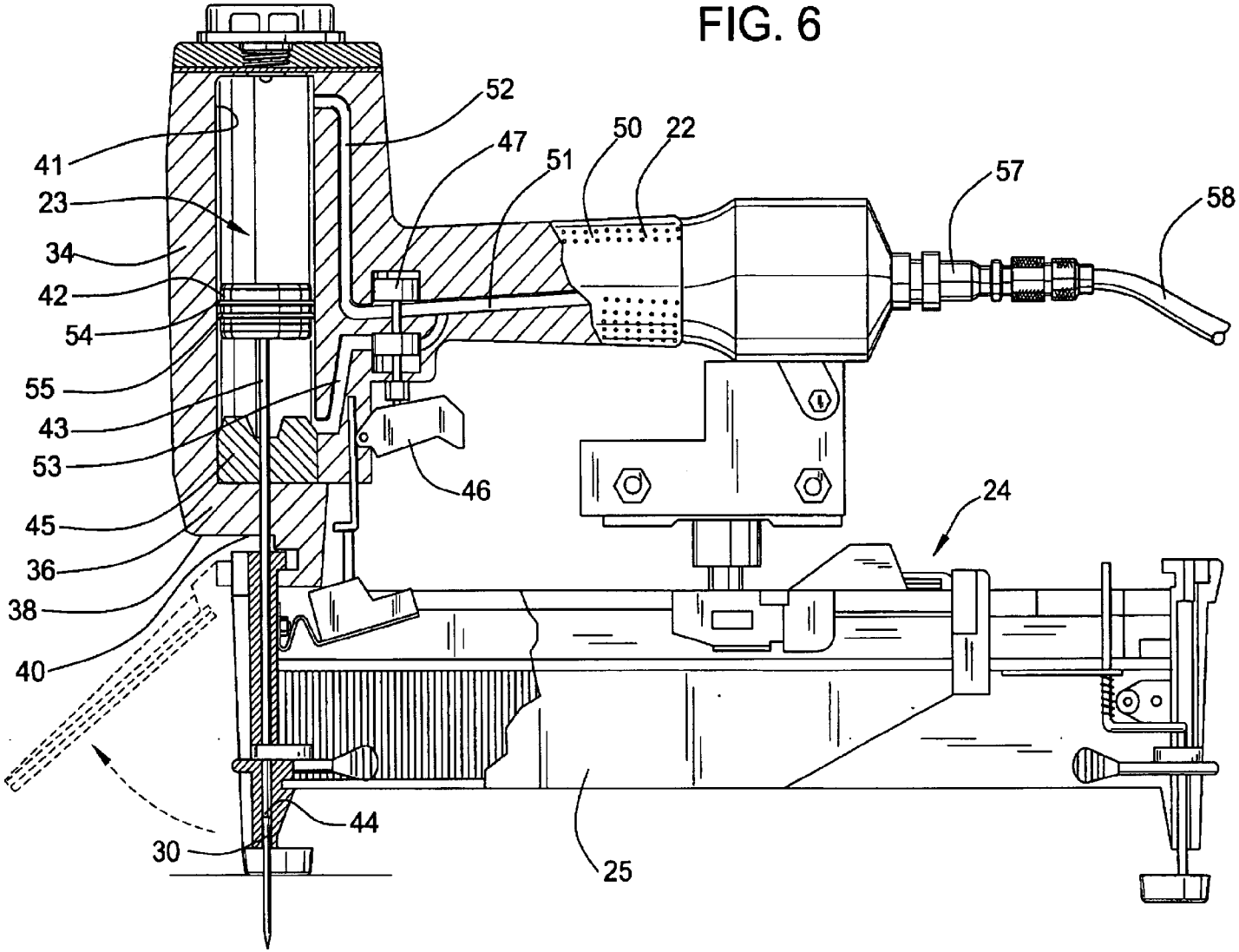
FIG. 6 is a second side elevational view, partially broken away, of the nail gun of FIG. 1, illustrating a drive mechanism operating to discharge a nail in a firing position.

Turning now to the drawings, there is shown in FIG. 1 an illustrative nail gun 20 constructed in accordance with the present invention. In this embodiment, the nail gun 20 is pneumatically-powered. The nail gun 20 is adapted to carry and to drive, selectively, different kinds of nails. The nail gun 20 includes a body 22 with a selectively operable drive mechanism 23, as shown in FIG. 6, and includes a nail storage mechanism 24 movably mounted to the body 22. The nail storage mechanism 24 is configured to store at least a first set of nails of a first type and a first size and a second set of nails of a second type and a second size. The first and second types can be different from each other. The first and second sizes can be different from each other. The nail storage mechanism 24 is movable to selectively position one of the nails in cooperative relationship with the drive mechanism for selectively discharging the nail from the nail storage mechanism for nailing.

Referring to FIG. 1, the nail storage mechanism 24 can include first and second supply magazines 25, 26 movably mounted to the body 22 and a mounting mechanism 28 for movably mounting the supply magazines 25, 26 to the body 22. In the illustrative nail gun 20, two supply magazines 25, 26 are provided in which nails of different sizes and types can be loaded and selectively moved into position for nailing as needed. The first and second supply magazines 25, 26 are pivotally mounted to the body 22 by the mounting mechanism 28.

Figure 2:
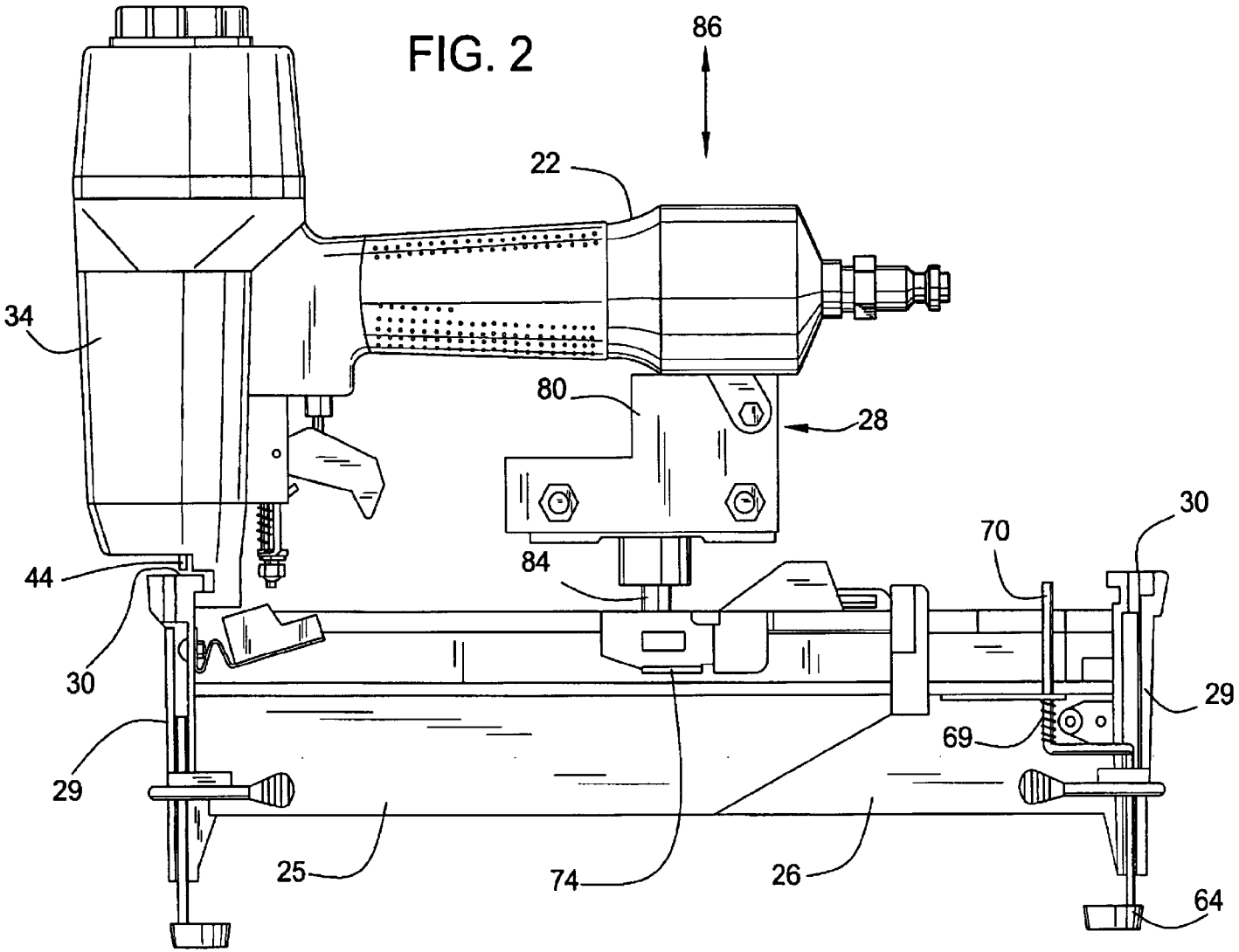
FIG. 2 is a second side elevational view of the nail gun of FIG. 1.

Referring to FIG. 2, each supply magazine 25, 26 includes a discharge end 29. Each supply magazine 25, 26 is capable of receiving a plurality of nails with one of the nails disposed in a firing position 30 adjacent the discharge end 29. Each supply magazine 25, 26 is configured to be selectively movable relative to the drive mechanism to a drive position wherein the supply magazine is operably arranged with the drive mechanism of the body 22 for selectively discharging the nail in the firing position from the supply magazine.

Figure 3:
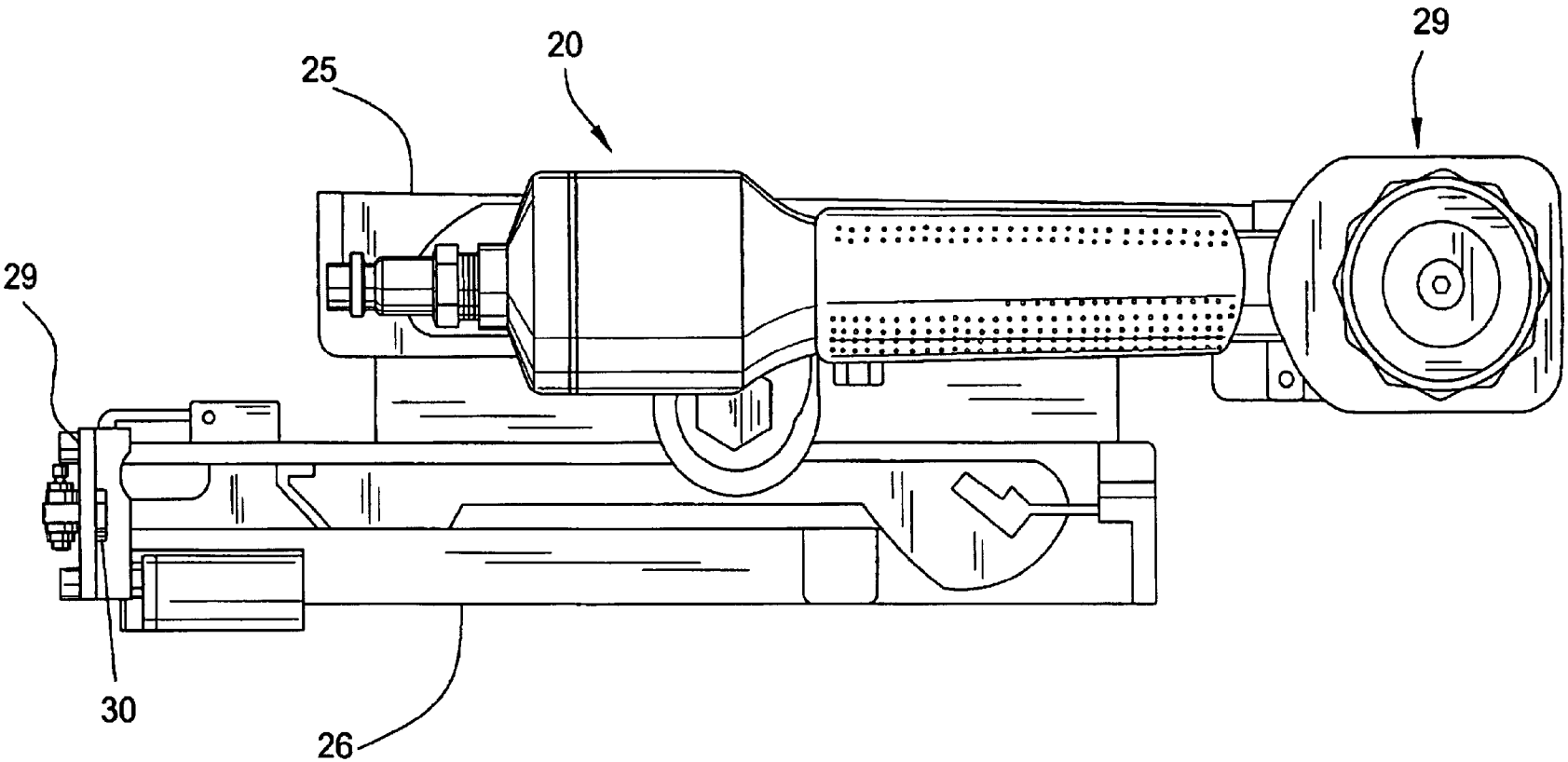
FIG. 3 is a top plan view of the nail gun of FIG. 1.
Figure 4:
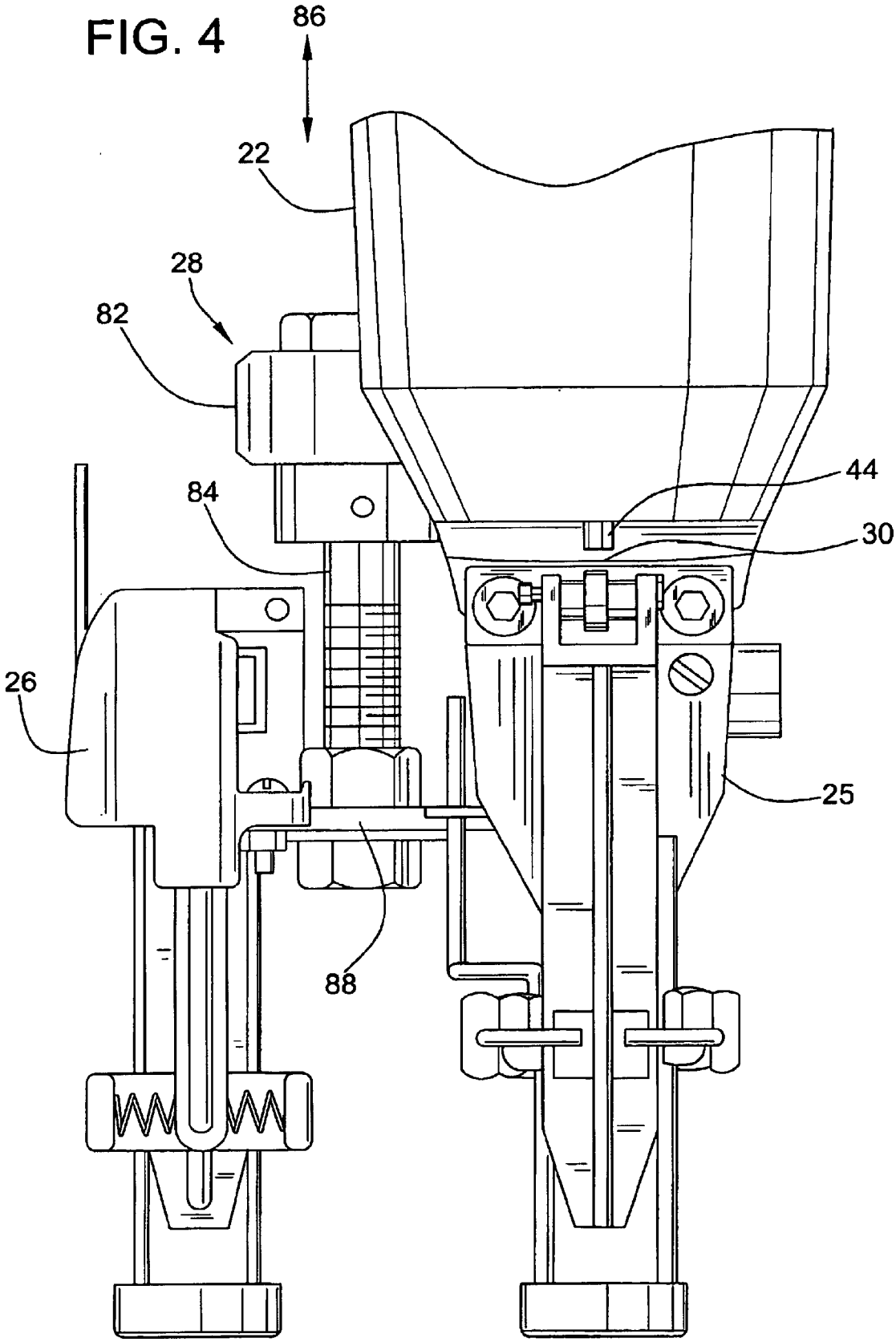
FIG. 4 is an enlarged, partial, front elevational view of the nail gun of FIG. 1.

Referring to FIGS. 3 and 4, the first and second supply magazines 25, 26 are in side-by-side relationship with each other with the respective discharge ends 29 facing away from each other. The first supply magazine 25 is in the drive position. The second supply magazine 26 can be in an idle position. When the second supply magazine 26 is in the drive position, the first supply magazine 25 can be in an idle position. The supply magazine in the drive position extends below the handle housing 50, spaced apart therefrom and in substantial alignment with the longitudinal axis thereof.

The first supply magazine 25 can contain a first supply of nails of one size and one type, and the second supply magazine 26 can contain a second supply of nails of another size and type. For example, the first supply magazine 25 can store a first supply of nails which are each 2½ inches in size, and the second supply magazine 26 can store a second supply of nails which are each 1¼ inches in size.

Referring to FIGS. 1 and 2, each supply magazine 25, 26 includes a spring-biased follower 74 for urging any nails received respectively therein toward the firing position. In the arrangement show in FIG. 2, upon operation of the nail gun 20, the follower 74 urges the plurality of nails received in the first supply magazine 25 toward the firing position such that the next adjacent nail is disposed therein.

Figure 5:
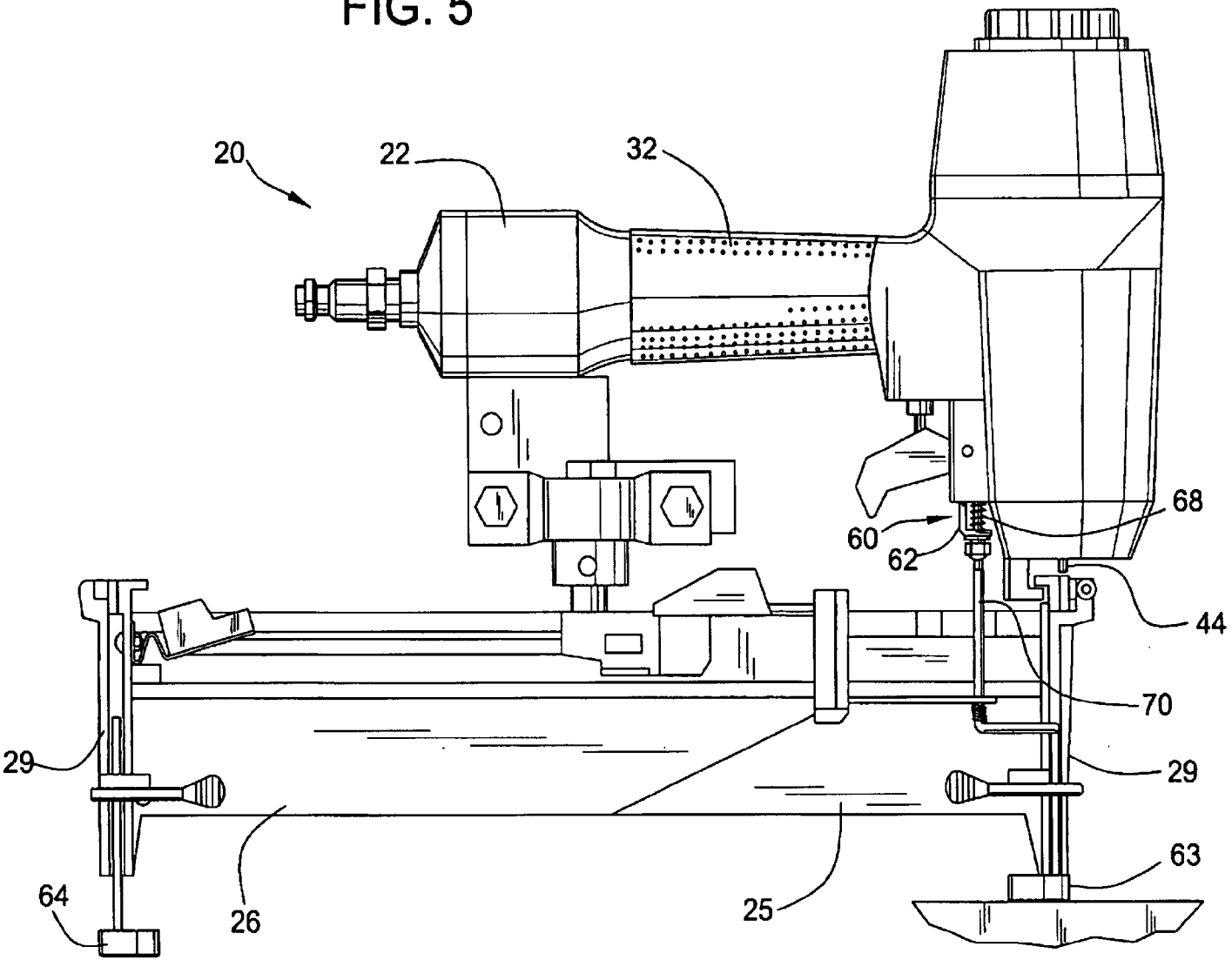
FIG. 5 is a first side elevational view of the nail gun as in FIG. 1, illustrating a safety mechanism in a disengaged position thereby allowing a drive mechanism to operate.

Referring to FIG. 5, to facilitate grasping the nail gun 20, the body 22 can include a gripping portion 32. The gripping portion 32 can be sized to be comfortably grasped by a user. The gripping portion can have different configurations. For example, the gripping portion 32 can have a different shape and can have a textured surface, a cushioned surface, or other suitable surface that is convenient for grasping.

Referring to FIG. 6, the body 22 includes a cylinder housing 34, which has a drive end 36 and a drive end wall 38 with a hole 40, therethrough. The drive mechanism 23 is housed within the body 22. The drive mechanism 23 can be of any construction known to those of ordinary skill in the art suitable for driving nails for nailing. The drive mechanism 23 can include an operating cylinder 41, a piston 42, and a piston drive rod 43 disposed in the cylinder housing 34. The piston drive rod 43 has an impact end 44 extending through the hole 40 of the cylinder housing 34 to selectively impact and drive the nail in the firing position 30 of the supply magazine in the drive position, which is the first supply magazine 25 in the case shown in FIG. 6. A bumper 45 is disposed within the cylinder 41 adjacent the drive end 36. The bumper 45 can act as a resilient stop for the piston 42 during operation of the drive mechanism 23. The drive mechanism 23 includes a trigger 46 for trigger-actuated, selective operation. The trigger 46 is operatively arranged with a trigger valve 47, such that upon actuation of the trigger 46, the trigger valve 47 is moved from a normal position to an actuating position, as shown FIG. 6.

The drive mechanism is pneumatically powered. To that end, the body 22 further includes a handle housing 50 including a main passage 51 in pneumatic connection with the drive mechanism 23. The main passage 51 can bifurcate into a drive passage 52 and a return passage 53. The drive passage 52 and the return passage 53 are both in pneumatic connection with the cylinder 41. A pair of O-rings 53, 54 can be disposed on a head 55 of the piston 42 to provide two seals between the piston 42 and the cylinder 41. A fitting 57 for connection to a hose line 58 leading to a pressurized pneumatic source is mounted to the body 22. The fitting 57 includes a passageway in pneumatic connection with the main passage 51.

In use, upon actuation of the trigger 46, the trigger valve 47 moves from the normal position to the actuation position, thereby sealing the return passage 53 and opening the drive passage 52 to allow compressed air to travel from the hose line 58 through the main passage 51 and the drive passage 52 and into the cylinder 41. The compressed air moves the piston 42 toward the nail in the firing position 30 to engage the nail and to drive it into a work surface. Upon release of the trigger 46, the trigger valve 47 returns to the normal position, thereby sealing the drive passage 52 and opening the return passage 53, which in turn allows compressed air to travel from the hose line 58 through the main passage 51 and the return passage 53 and into the cylinder 41. The compressed air moves the piston away from the supply magazine 25 to its normal position as shown in FIG. 1. In other embodiments, the drive mechanism can be powered by other means, such as by being powder-actuated or electrically-actuated, for example.

Referring to FIG. 5, to decrease the chance of the unintentional operation of the nail gun 20, the drive mechanism can include a safety mechanism 60 which can be engaged to prevent the drive mechanism from operating and disengaged to allow the drive mechanism to operate. The safety mechanism 60 can include a plunger 62 movably mounted to the body 22 and first and second nosepieces 63, 64 corresponding to the first and second supply magazines 25, 26 and respectively movably mounted thereto adjacent the discharge end 29 thereof. The plunger 62 can be biased by a plunger spring 68 to a safety position as shown in FIG. 1, wherein the safety mechanism 60 is engaged. As shown in FIGS. 1 and 2, each nosepiece 63, 64 can be biased by a nose spring 69 to an extended position wherein the nosepiece 63, 64 is spaced apart from the body 22 to allow the respective supply magazine 25, 26 to move without interference therefrom. Each nosepiece 63, 64 includes a post 70 to engage the plunger 62.

Referring to FIG. 5, each nosepiece 63, 64 can be configured such that when the supply magazine 25, 26 to which it is mounted is in the drive position, the nosepiece 63, 64 is movable to a depressed position wherein the post 70 of the respective nosepiece 63, 64 engages the plunger 62 to thereby move the plunger 62 to a firing position wherein the safety mechanism 60 is disengaged. As shown in FIG. 5, the nosepiece 63 of the first supply magazine 25 is in the depressed position, thereby moving the plunger 62 to the firing position to disengage the safety mechanism 60 so that the drive mechanism is able to operate.

Referring to FIGS. 1 and 2, the mounting mechanism 28 is provided for pivotally mounting the supply magazines 25, 26 to the body 22. The mounting mechanism 28 is configured to locate the supply magazines 25, 26 in position relative to the cylinder housing 34 whereby the drive mechanism therein, including the impact end 44 of the piston drive rod, is in registration with a nail in the firing position 30 of a respective one of the supply magazines 25, 26 in the drive position. The mounting mechanism 28 includes a body-mounting member 80 having a bearing 82, a pivot member 84 having a longitudinal axis 86, and a magazine-mounting member 88, as shown in FIG. 4.

Referring to FIG. 1, the body-mounting member 80 depends from the body 22. The pivot member 84 is rotationally mounted to the body-mounting member 80, being journaled to the body-mounting member 80 by the bearing 82 such that the pivot member 84 can rotate about the longitudinal axis 86. Referring to FIG. 4, the magazine-mounting member 88 is mounted to the pivot member 84. The first and second supply magazines 25, 26 are mounted to the magazine-mounting member 88.

Figure 8:
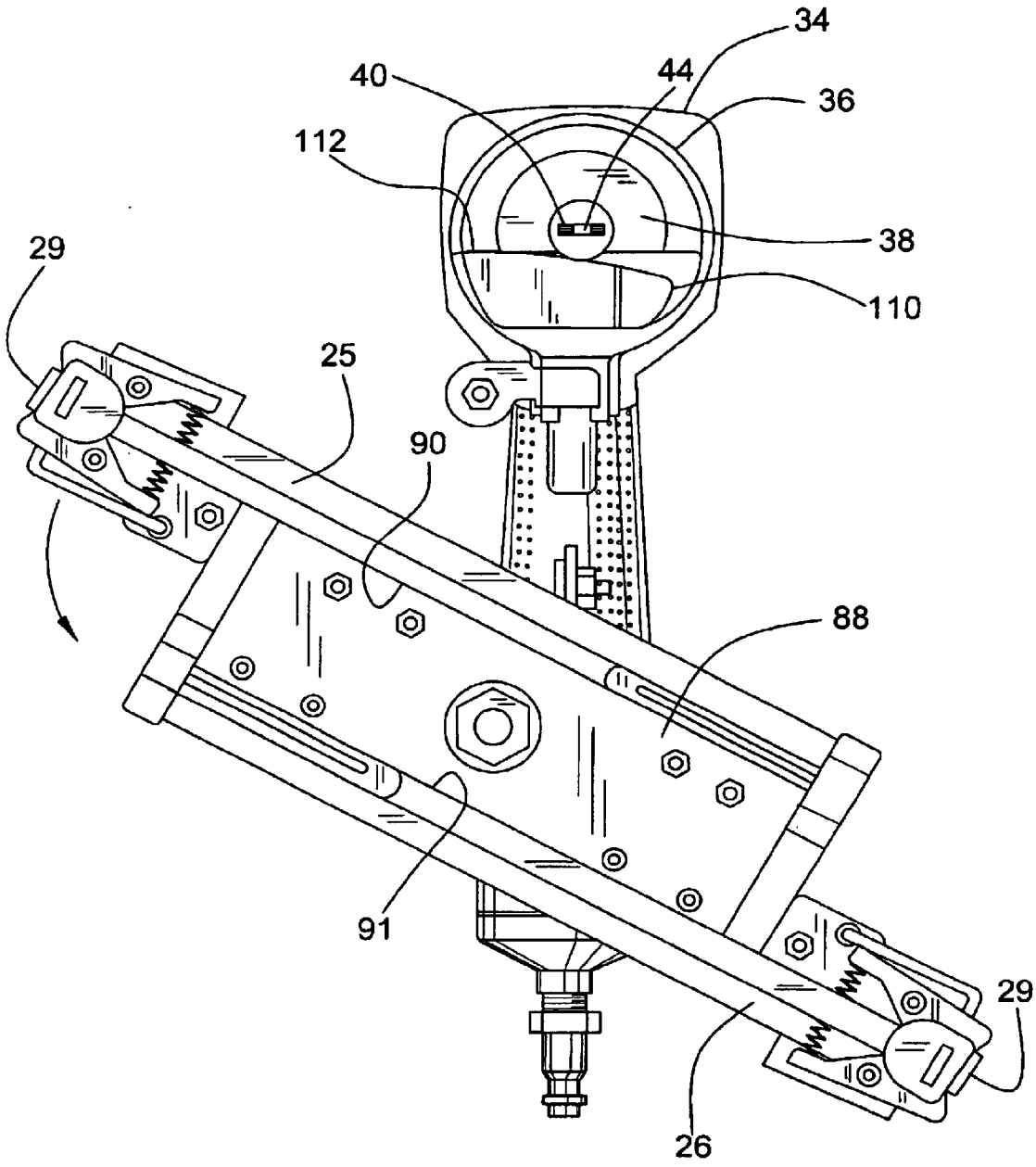
FIG. 8 is a bottom plan view of the nail gun of FIG. 1 similar to FIG. 7.

Referring to FIG. 8, the magazine-mounting member 88 is elongated and includes a first side 90 and an opposing second side 91 spaced apart therefrom and substantially parallel thereto. The first and second supply magazines 25, 26 respectively depend from the first and second sides 90, 91. The first and second supply magazines 25, 26 are bolted or otherwise secured to the first and second sides 90, 91. The discharge ends 29 of the first and second supply magazines 25, 26 are disposed in opposing relationship to each other.

Figure 7:
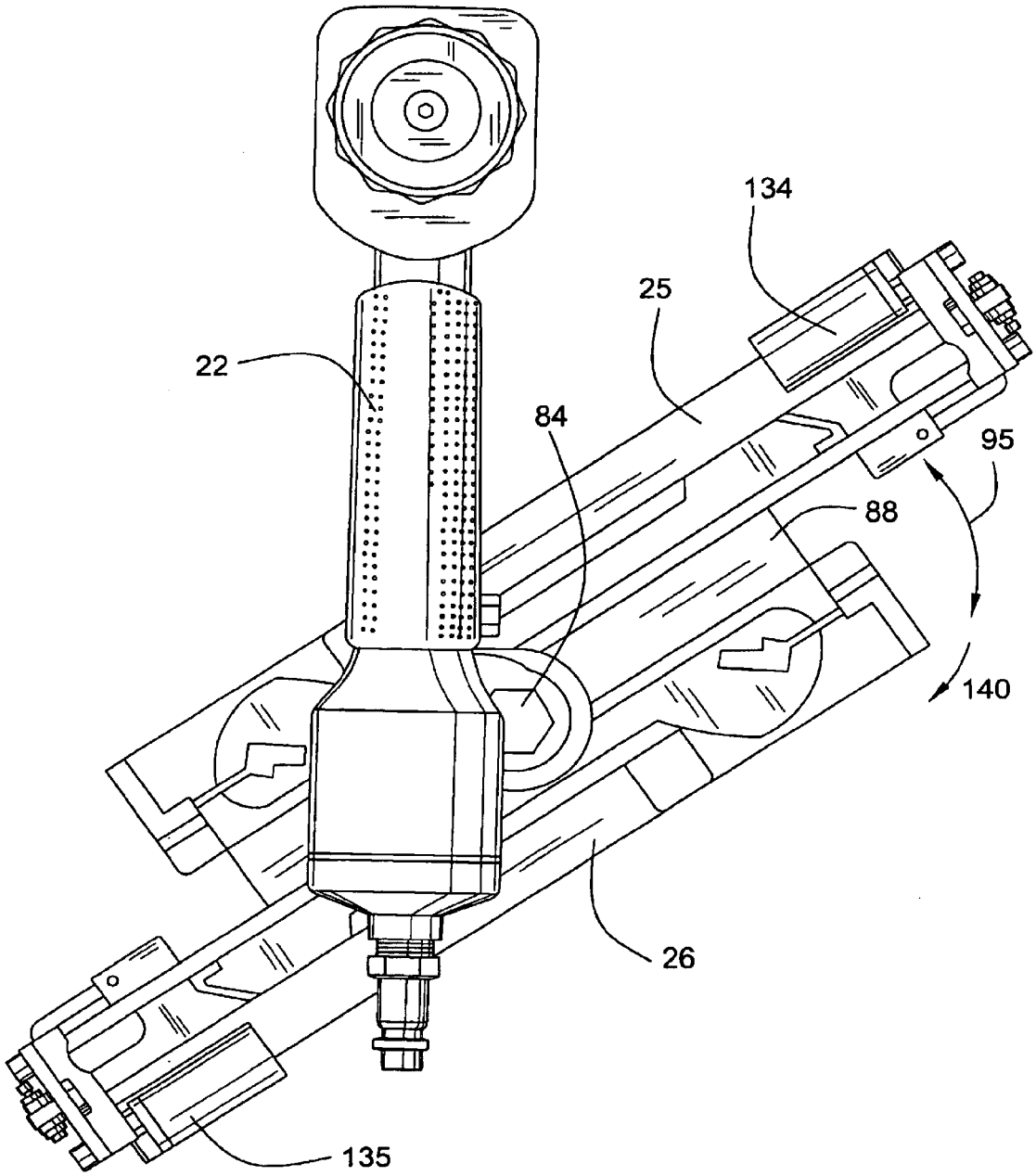
FIG. 7 is a top plan view of the nail gun of FIG. 1 similar to FIG. 3 illustrating the supply magazines in intermediate positions.

Referring to FIGS. 7 and 8, the first supply magazine 25 can be moved from the drive position to an intermediate position by rotating the first supply magazine 25 about the pivot member 84. The first supply magazine 25 and the second supply magazine 26 are in one of a range of intermediate positions wherein neither the first supply magazine 25 nor the second supply magazine 26 is in the drive position. The first and second supply magazines 25, 26 along with the magazine-mounting member 88 can be rotated about the pivot member in either a clockwise direction or a counter-clockwise direction as indicated by a bi-directional arrow 95 in FIG. 7. The supply magazines 25, 26 and the magazine-mounting member 88 can be moved about the pivot member 84 to place the second supply magazine 26 in the drive position.

Figure 9:
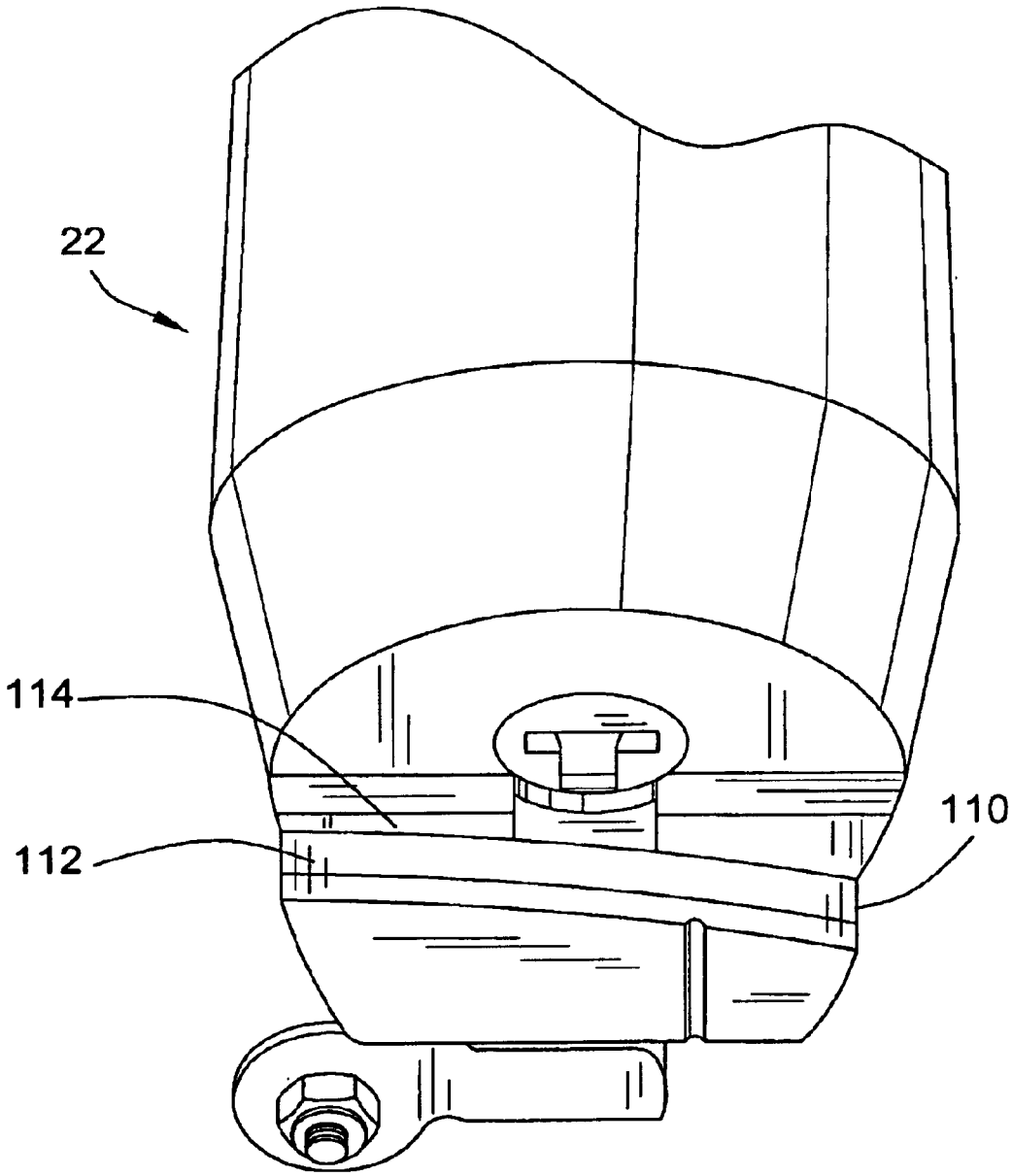
FIG. 9 is an enlarged, partial, perspective view of the nail gun of FIG. 1 from the front and bottom.

Referring to FIG. 9, to support the nail storage mechanism, the body 22 can include a supply magazine support mechanism 110 having a shoulder 112 and a laterally extending groove 114. Referring to FIG. 1, each supply magazine 25, 26 includes a stabilizing rib 116 at the discharge end 29 configured to fit through the groove 114 and to engage the shoulder 112. The supply magazine support mechanism 110 cooperates with the supply magazine disposed in the drive position such that the stabilizing rib 116 extends through the groove 114 and the shoulder 112 supports the stabilizing rib 116.

Referring to FIG. 1, the first supply magazine 25 is in the drive position. The supply magazine support mechanism 110 acts in this instance to support the first supply magazine 25. The stabilizing rib 116 of the first supply magazine 25 is disposed in the groove 114 and is engaged with the shoulder 112. The impact end 44 of the drive mechanism is aligned with the firing position at the discharge end 29 of the first supply magazine 25 and is in registration with a nail urged forwardly into such firing position by the follower. The second supply magazine can be selectively moved into the drive position wherein the second supply magazine cooperates with the support mechanism 110 in a fashion similar to the first supply magazine 25.

Referring to FIG. 8, to facilitate the movement of the supply magazines 25, 26, the shoulder 112 of the supply magazine support mechanism 110 can be shaped to substantially conform to the path of rotational travel of the stabilizing ribs.

Figure 10:
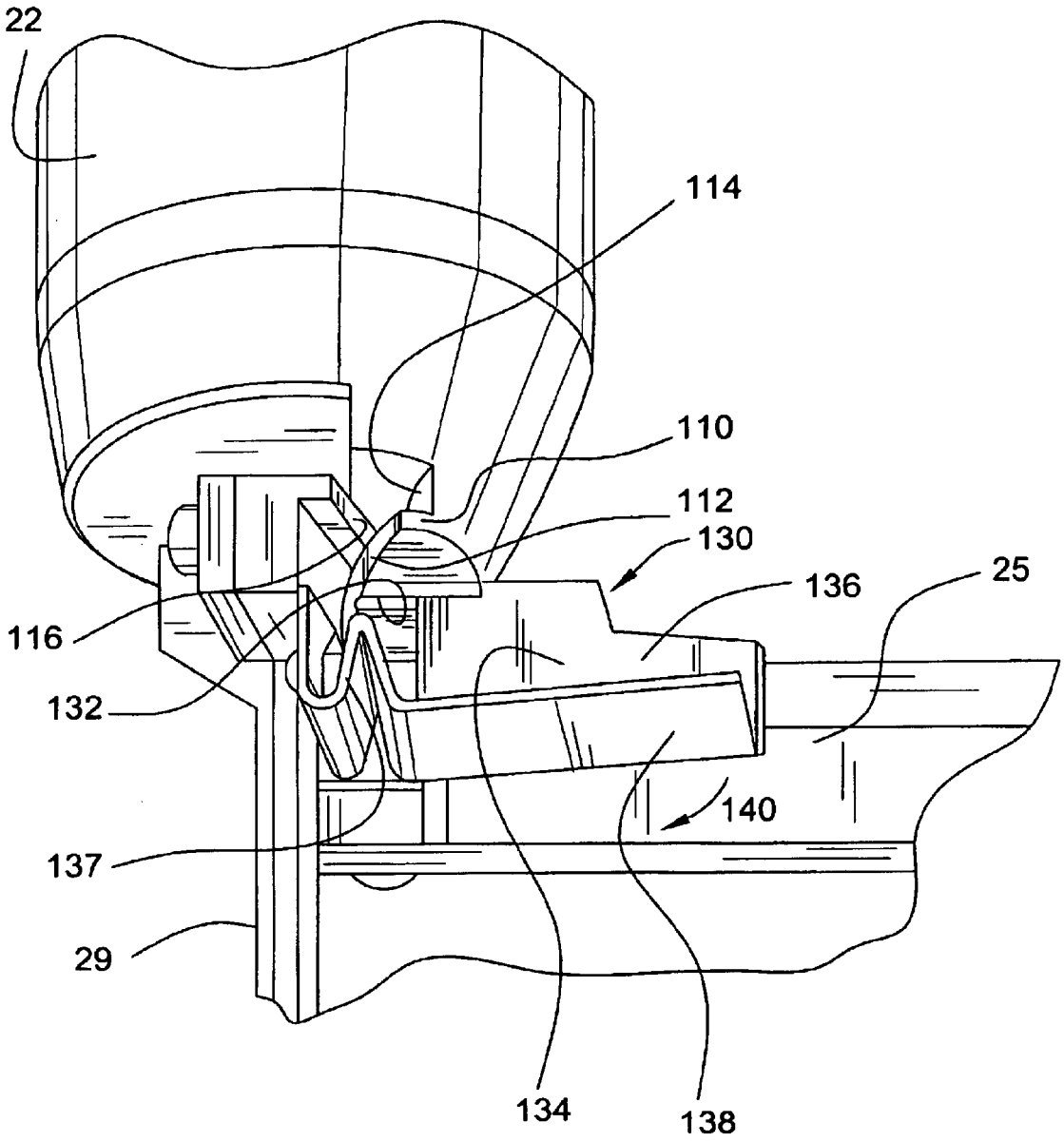
FIG. 10 is an enlarged, partial, perspective view of the nail gun of FIG. 1 from the second side.

Referring to FIG. 10, to selectively retain one of the supply magazines in the drive position, a retaining mechanism 130 can be provided. Referring to FIGS. 1 and 10, the retaining mechanism 130 can include a recess 132 disposed in the body 22 and a plurality of catches 134, 135 corresponding to the plurality of supply magazines 25, 26. The recess 132 is in the shape of a notch and is disposed on the shoulder 112. The first and second catches 134, 135 are respectively mounted to the supply magazines 25, 26 adjacent the discharge end 29. Each catch 134, 135 is configured to releasably engage the recess 132 to retain the supply magazine to which the respective catch is mounted in the drive position.

Each catch 134, 135 includes a blade portion 136 biased by a spring portion 137 toward a catch position wherein the catch 134, 135 is engageable with the recess 132. Each catch 134, 135 includes a handle portion 138.

Referring to FIG. 10, the retaining mechanism 130 acts to retain the first supply magazine 25 in the drive position. The catch 134 of the first supply magazine 25 is engaged with the recess 132, thereby retaining the first supply magazine 25 in the drive position. To release the first supply magazine 25, the handle portion 138 of the catch 134 can be moved in a release direction 140 to disengage the catch 134 from the recess 132. Once the catch 134 is disengaged from the recess 132, the first supply magazine 25 can be moved with respect to the body 22. When the handle portion 138 is released, the catch 134 is urged to the catch position by the spring portion 137.

In other embodiments, the recess and the catches can have different configurations. For example, the catch can be hook-shaped, and the recess can be an eyelet or other structure capable of receiving a hook. In other embodiments, the catch can be a convex protrusion that is generally hemispherical, and the recess can be a concave depression that has a shape complementary to the shape of the catch.

Referring to FIG. 7, when a nail of the size being carried in the second supply magazine 26 is desired to be driven into a work piece, the first catch 134 can be released from the recess to allow the supply magazines 25, 26 to rotate about the pivot member 84. The magazine mounting member 88 has been rotated about the pivot member 84 to move the first supply magazine 25 out of the drive position. The second supply magazine 26 can be rotated in a clockwise direction 140 to the drive position. The second supply magazine 26 can be moved in the clockwise direction 140 until the catch 135 of the second supply magazine 26 engages the recess to retain the second supply magazine 26, whereupon the second supply magazine 26 is in the drive position such that the nail in the firing position of the second supply magazine 26 is in axial registration with the drive mechanism. When the second supply magazine 26 is in the drive position, its stabilizing rib extends through the groove and engages the shoulder 112 of the body 22 as the first supply magazine 25 had when the first supply magazine 25 was in the drive position.

Alternatively, the supply magazines 25, 26 can be rotated about the pivot member in a counterclockwise direction to move the first supply magazine 25 out of the drive position and to move the second supply magazine 26 into the drive position. The supply magazines 25, 26 can be rotated in either a clockwise or a counterclockwise direction to move the second supply magazine 26 out of the drive position and to move the first supply magazine 25 into the drive position.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments would become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A nail gun comprising:

a body including a selectively operable drive mechanism and a gripping portion;

a plurality of supply magazines movably mounted to the body, each supply magazine including a discharge end and capable of receiving a plurality of nails with one of the nails disposed in a firing position adjacent the discharge end, each supply magazine configured to be selectively moved relative to the drive mechanism to a drive position wherein the supply magazine is operably arranged with the drive mechanism for selectively discharging the nail in the firing position from the supply magazine; and a retaining mechanism for selectively retaining one of the supply magazines in the drive position, the retaining mechanism includings a recess disposed in the body and a plurality of catches corresponding to the plurality of supply magazines and respectively mounted thereto adjacent the discharge end, each catch configured to releasably engage the recess to retain the supply magazine to which the catch is mounted in the drive position.

2. The nail gun as described in claim 1 wherein the drive mechanism includes a trigger for trigger-actuated selective operation.

3. The nail gun as described in claim 1 wherein the drive mechanism is pneumatically powered.

4. The nail gun as described in claim 3 wherein the body further includes a housing, the housing including a chamber in pneumatic connection with the drive mechanism, and a fitting for connection to a hose line leading to a pressurized pneumatic source, the fitting including a passageway in pneumatic connection with the chamber.

5. The nail gun as described in claim 1 wherein the drive mechanism includes a safety mechanism which can be engaged to prevent the drive mechanism from operating and disengaged to allow the drive mechanism to operate.

6. The nail gun as described in claim 5 wherein the safety mechanism includes a plunger movably mounted to the body and a plurality of nosepieces corresponding to the plurality of supply magazines and respectively movably mounted thereto adjacent the discharge end, the plunger biased to a safety position wherein the safety mechanism is engaged, each nosepiece biased to an extended position wherein the nosepiece is spaced apart from the body to allow the supply magazine to move without interference therefrom, each nosepiece configured such that when the supply magazine to which it is mounted is in the drive position, the nosepiece is movable to a depressed position wherein the nosepiece engages the plunger to thereby move the plunger to a firing position wherein the safety mechanism is disengaged.

7. The nail gun as described in claim 6 wherein each nosepiece includes a post to engage the plunger.

8. The nail gun as described in claim 1 wherein the body includes a cylinder housing, the cylinder housing having a drive end and a drive end wall with a hole therethrough, and wherein the drive mechanism includes an operating cylinder, a piston, and a piston drive rod with an impact end, the operating cylinder, the piston and the piston drive rod disposed in the cylinder housing, the impact end extending through the hole of the cylinder housing to selectively impact and drive the nail in the firing position of the supply magazine in the drive position, said nail being in axial registration with the impact end of the piston drive rod.

9. The nail gun as described in claim 1 wherein the body includes a supply magazine support mechanism having a shoulder and a laterally extending groove, each supply magazine including a stabilizing rib at the discharge end configured to fit through the groove and to engage the shoulder, the supply magazine support mechanism cooperating with the supply magazine disposed in the drive position such that the stabilizing rib extends through the groove and the shoulder supports the stabilizing rib.

10. The nail gun as described in claim 9 further comprising:

a mounting mechanism for pivotally mounting the supply magazines to the body, wherein each stabilizing rib is pivotable about the mounting mechanism along a supply magazine circumference, and the shoulder of the supply magazine support mechanism is shaped to substantially conform to the supply magazine circumference.

11. The nail gun described in claim 1 wherein each supply magazine includes a biased follower for urging the plurality of nails received therein toward the firing position.

12. The nail gun as described in claim 1 further comprising:

a mounting mechanism for pivotally mounting the supply magazines to the body.

13. The nail gun as described in claim 1 wherein each catch is biased toward a catch position wherein the catch is engageable with the recess and includes a handle portion.

14. The nail gun as described in claim 1 wherein the nail gun comprises:

a first and second supply magazine, the first supply magazine containing a first supply of nails, the second supply magazine containing a second supply of nails.

15. The nail gun as described in claim 14 wherein the first supply of nails are a first size, and the second supply of nails are a second size, the first size and the second size being different from each other.

16. The nail gun as described in claim 14 wherein the first supply of nails are a first type, and the second supply of nails are a second type, the first type and the second type being different from each other.

17. The nail gun as described in claim 16 wherein the first supply of nails are a first size, and the second supply of nails are a second size, the first size and the second size being different from each other.

18. The nail gun as described in claim 14 wherein when the first supply magazine is in the drive position, the second supply magazine is in an idle position, and when the second supply magazine is in the drive position, the first supply magazine is in an idle position.

19. The nail gun as described in claim 14 further comprising:

a mounting mechanism for pivotally mounting the supply magazines to the body, the mounting mechanism including a body-mounting member having a bearing, a pivot member having a longitudinal axis, and a magazine-mounting member, the body-mounting member depending from the body and including a bearing, the pivot member rotationally mounted to the body-mounting member, being journaled to the bearing such that the pivot rod can rotate about its longitudinal axis, the magazine-mounting member mounted to the pivot member, and the first and second supply magazines mounted to the magazine-mounting member.

20. The nail gun as described in claim 19 wherein the magazine-mounting member is elongated and includes a first side and an opposing second side spaced apart therefrom and substantially parallel thereto, the first and second supply magazines respectively depending from the first and second sides, the discharge ends of the first and second supply magazines disposed in opposing relationship to each other.

21. A nail gun comprising:

a body including a selectively operable drive mechanism and a gripping portion, the drive mechanism including a safety mechanism which can be engaged to prevent the drive mechanism from operating and disengaged to allow the drive mechanism to operate; and a plurality of supply magazines movably mounted to the body, each supply magazine including a discharge end and capable of receiving a plurality of nails with one of the nails disposed in a firing position adjacent the discharge end, each supply magazine configured to be selectively moved relative to the drive mechanism to a drive position wherein the supply magazine is operably arranged with the drive mechanism for selectively discharging the nail in the firing position from the supply magazine;

wherein the safety mechanism includes a plunger movably mounted to the body and a plurality of nosepieces corresponding to the plurality of supply magazines and respectively movably mounted thereto adjacent the discharge end, the plunger biased to a safety position wherein the safety mechanism is engaged, each nosepiece biased to an extended position wherein the nosepiece is spaced apart from the body to allow the supply magazine to move without interference therefrom, each nosepiece configured such that when the supply magazine to which it is mounted is in the drive position, the nosepiece is movable to a depressed position wherein the nosepiece engages the plunger to thereby move the plunger to a firing position wherein the safety mechanism is disengaged.

22. The nail gun as described in claim 21 wherein the drive mechanism includes a trigger for trigger-actuated selective operation.

23. The nail gun as described in claim 21 wherein the drive mechanism is pneumatically powered.

24. The nail gun as described in claim 23 wherein the body further includes a housing, the housing including a chamber in pneumatic connection with the drive mechanism, and a fitting for connection to a hose line leading to a pressurized pneumatic source, the fitting including a passageway in pneumatic connection with the chamber.

25. The nail gun as described in claim 21 wherein each nosepiece includes a post to engage the plunger.

26. The nail gun as described in claim 21 wherein the body includes a cylinder housing, the cylinder housing having a drive end and a drive end wall with a hole therethrough, and wherein the drive mechanism includes an operating cylinder, a piston, and a piston drive rod with an impact end, the operating cylinder, the piston and the piston drive rod disposed in the cylinder housing, the impact end extending through the hole of the cylinder housing to selectively impact and drive the nail in the firing position of the supply magazine in the drive position, said nail being in axial registration with the impact end of the piston drive rod.

27. The nail gun as described in claim 21 wherein the body includes a supply magazine support mechanism having a shoulder and a laterally extending groove, each supply magazine including a stabilizing rib at the discharge end configured to fit through the groove and to engage the shoulder, the supply magazine support mechanism cooperating with the supply magazine disposed in the drive position such that the stabilizing rib extends through the groove and the shoulder supports the stabilizing rib.

28. The nail gun as described in claim 27 further comprising:

a mounting mechanism for pivotally mounting the supply magazines to the body, wherein each stabilizing rib is pivotable about the mounting mechanism along a supply magazine circumference, and the shoulder of the supply magazine support mechanism is shaped to substantially conform to the supply magazine circumference.

29. The nail gun as described in claim 21 wherein each supply magazine includes a biased follower for urging the plurality of nails received therein toward the firing position.

30. The nail gun as described in claim 21 further comprising:

a mounting mechanism for pivotally mounting the supply magazines to the body.

31. The nail gun as described in claim 21 wherein the nail gun comprises:

a first and second supply magazine, the first supply magazine containing a first supply of nails, the second supply magazine containing a second supply of nails.

32. A nail gun comprising:

a body including a selectively operable drive mechanism and a gripping portion; and a plurality of supply magazines movably mounted to the body, each supply magazine including a discharge end and capable of receiving a plurality of nails with one of the nails disposed in a firing position adjacent the discharge end, each supply magazine configured to be selectively moved relative to the drive mechanism to a drive position wherein the supply magazine is operably arranged with the drive mechanism for selectively discharging the nail in the firing position from the supply magazine;

wherein the body includes a supply magazine support mechanism having a shoulder and a laterally extending groove, each supply magazine including a stabilizing rib at the discharge end configured to fit through the groove and to engage the shoulder, the supply magazine support mechanism cooperating with the supply magazine disposed in the drive position such that the stabilizing rib extends through the groove and the shoulder supports the stabilizing rib.

33. The nail gun as described in claim 32 wherein the drive mechanism includes a trigger for trigger-actuated selective operation.

34. The nail gun as described in claim 32 wherein the drive mechanism is pneumatically powered.

35. The nail gun as described in claim 34 wherein the body further includes a housing, the housing including a chamber in pneumatic connection with the drive mechanism, and a fitting for connection to a hose line leading to a pressurized pneumatic source, the fitting including a passageway in pneumatic connection with the chamber.

36. The nail gun as described in claim 32 wherein the body includes a cylinder housing, the cylinder housing having a drive end and a drive end wall with a hole therethrough, and wherein the drive mechanism includes an operating cylinder, a piston, and a piston drive rod with an impact end, the operating cylinder, the piston and the piston drive rod disposed in the cylinder housing, the impact end extending through the hole of the cylinder housing to selectively impact and drive the nail in the firing position of the supply magazine in the drive position, said nail being in axial registration with the impact end of the piston drive rod.

37. The nail gun as described in claim 32 wherein each supply magazine includes a biased follower for urging the plurality of nails received therein toward the firing position.

38. The nail gun as described in claim 32 further comprising:

a mounting mechanism for pivotally mounting the supply magazines to the body.

39. The nail gun as described in claim 38 wherein each stabilizing rib is pivotable about the mounting mechanism along a supply magazine circumference, and the shoulder of the supply magazine support mechanism is shaped to substantially conform to the supply magazine circumference.

40. A nail gun comprising:

a body including a selectively operable drive mechanism and a gripping portion;

a first and second supply magazine each movably mounted to the body, each supply magazine including a discharge end and capable of receiving a plurality of nails with one of the nails disposed in a firing position adjacent the discharge end, each supply magazine configured to be selectively moved relative to the drive mechanism to a drive position wherein the supply magazine is operably arranged with the drive mechanism for selectively discharging the nail in the firing position from the supply magazine, the first supply magazine containing a first supply of nails, the second supply magazine containing a second supply of nails; and a mounting mechanism for pivotally mounting the supply magazines to the body, the mounting mechanism including a body-mounting member having a bearing, a pivot member having a longitudinal axis, and a magazine-mounting member, the body-mounting member depending from the body and including a bearing, the pivot member rotationally mounted to the body-mounting member, being journaled to the bearing such that the pivot rod can rotate about its longitudinal axis, the magazine-mounting member mounted to the pivot member, and the first and second supply magazines mounted to the magazine-mounting member.

41. The nail gun as described in claim 40 wherein the first supply of nails are a first size, and the second supply of nails are a second size, the first size and the second size being different from each other.

42. The nail gun as described in claim 40 wherein the first supply of nails are a first type, and the second supply of nails are a second type, the first type and the second type being different from each other.

43. The nail gun as described in claim 42 wherein the first supply of nails are a first size, and the second supply of nails are a second size, the first size and the second size being different from each other.

44. The nail gun as described in claim 40 wherein when the first supply magazine is in the drive position, the second supply magazine is in an idle position, and when the second supply magazine is in the drive position, the first supply magazine is in an idle position.

45. The nail gun as described in claim 40 wherein the magazine-mounting member is elongated and includes a first side and an opposing second side spaced apart therefrom and substantially parallel thereto, the first and second supply magazines respectively depending from the first and second sides, the discharge ends of the first and second supply magazines disposed in opposing relationship to each other.

* * * * *